United States Patent [19]

Banting

[11] Patent Number: 4,651,909

[45] Date of Patent: Mar. 24, 1987

[54] MANUALLY OPERABLE DEVICE FOR APPLYING SOCKS

[76] Inventor: Gregory Banting, 53 Bond Street North, Hamilton, Ontario, Canada, L9H 3A7

[21] Appl. No.: 778,008

[22] Filed: Sep. 20, 1985

[30] Foreign Application Priority Data

Sep. 17, 1985 [CA] Canada ..... 490957

[51] Int. Cl.[4] ..... A47G 25/90

[52] U.S. Cl. ..... 223/111

[58] Field of Search ..... 223/111, 112, 118, 119

[56] References Cited

U.S. PATENT DOCUMENTS

| | | | |
|---|---|---|---|
| 3,396,883 | 8/1968 | Batista | 223/118 |
| 3,452,907 | 7/1969 | MacLauchlan | 223/111 |

FOREIGN PATENT DOCUMENTS

| | | | |
|---|---|---|---|
| 1912400 | 10/1970 | Fed. Rep. of Germany | 223/112 |
| 7603558 | 2/1976 | France | 223/112 |
| 7520173 | 2/1977 | France | 223/111 |

*Primary Examiner*—Werner H. Schroeder

*Assistant Examiner*—Andrew M. Falik

[57] ABSTRACT

A manually operable device for applying socks or the like onto the leg of the user. The device comprises of a flexible sheet material having a toe portion at one end thereof with two opposite diverging edge formations adapted to flex towards each other upon application of a sock distended thereon, so as to present a cavity between the toe portion and sock for insertion of a foot. The toe edge formations terminate at opposite lateral engaging projections to releasably frictionally engage the sock. The device has a heel portion with two opposite diverging edge formations at the other end of the sheet material, which is integrally connected to the toe portion in the region adjacent the engaging projections so as to present a flexible connecting portion to permit hinged flexure of the heel portion relative the toe portion. A thread is connected to the heel portion and adapted to be pulled so as to draw the toe portion with the sock over the foot thereby unravelling the sock from the engaging projections and permitting the heel portion to flex over the heel of the operator for drawing the sock over the leg.

7 Claims, 9 Drawing Figures

MANUALLY OPERABLE DEVICE FOR APPLYING SOCKS

FIELD OF INVENTION

This invention relates to a manually-operable device for applying socks or the like to a foot of a user, which device flexes over the heel during application.

DESCRIPTION OF THE PRIOR ART

A certain sector of the population have limited bending capabilities of the body or legs. Such limited bending capabilities may be due to crippling arthitis, obesity, heart ailments so or other physical handicaps, all of which prevent the user from bending sufficiently to place stockings or the like onto their feet without aid.

Many tools have heretofore been devised for assisting such persons in applying stockings or the like onto the foot.

For example, U.S. Pat. No. 3,452,907 discloses a resilient device comprising a foot member presenting two straps, one strap which is connected to the foot member adapted to pull the device up the leg, while the second strap is attached to the first strap and clipped to the stocking and adapted to pull the stocking up simultaneously with the foot member.

U.S. Pat. No. 3,401,856 teaches a "U-shaped" trough-like device made of fabricated plastic in which the foot is placed after the stocking is placed over the chordally truncated cylinder with handle or strap attached.

Furthermore, U.S. Pat. No. 3,853,252 illustrates a slide member having a handle extending rearwardly thereof. The stocking is placed on the slide member which is curved and wide enough to allow entry of the wearer's foot, and which is narrow at its front so as not to stretch the sockwear.

Moreover, U.S. Pat. No. 3,310,209 teaches an open-ended panlike slide member which when inserted into a sock will allow for the insertion of the wearer's foot. This device contains protrusions on the sidewalls to hold the sock in place and allow for a timely unravelling as it is pulled up the leg.

Finally, U.S. Pat. No. 2,828,057 discloses a device having a base for receiving the foot of the user, a pair of side members which are tapered to the front and a hump over which the sock is lodged. The device has manipulating handles attached and straps connected thereto to be attached to the stocking. Once the foot is lodged and the sockwear applied on the foot, the base may be removed and the sockwear pulled up by way of the straps.

Such prior devices present relatively complicated devices. Furthermore, the devices disclosed in the prior art tend to stretch the sock as it is applied over the heel of the user which may cause the sock to fall off the device before clearing the heel of the user.

SUMMARY OF INVENTION

This invention relates to a manually-operable device for applying socks or the like comprising: a flexible sheet material having; a toe portion at one end thereof with two opposite diverging edge formations adapted to flex towards each other upon application of a sock distended thereon so as to present a cavity between the toe portion and sock for insertion of the foot; said toe edge formations terminating at opposite lateral engaging projections adapted to releasably frictionally engage said sock; a heel portion having two opposite diverging edge formations at the other end of said sheet material, integrally connected to said toe portion in the region adjacent said engaging projections so as to present a flexible connecting portion to permit hinged flexture of said heel portion relative said toe portion; thread means connected to said heel portion and adapted to be pulled so as to draw said toe portion with said sock over the foot thereby unravelling said sock from said engaging projections and permitting said heel portion to flex over the heel of the operator and thereby drawing said sock over the leg.

Moreover the opposite lateral engaging projections may be offset along the length of the device, and a score line may be presented on the convex side of said device between the lateral engaging projections.

DETAILED DESCRIPTION OF THE PREFERRED EMBODIMENT

Like parts have been given identical numbers throughout the figures.

Figure 1:
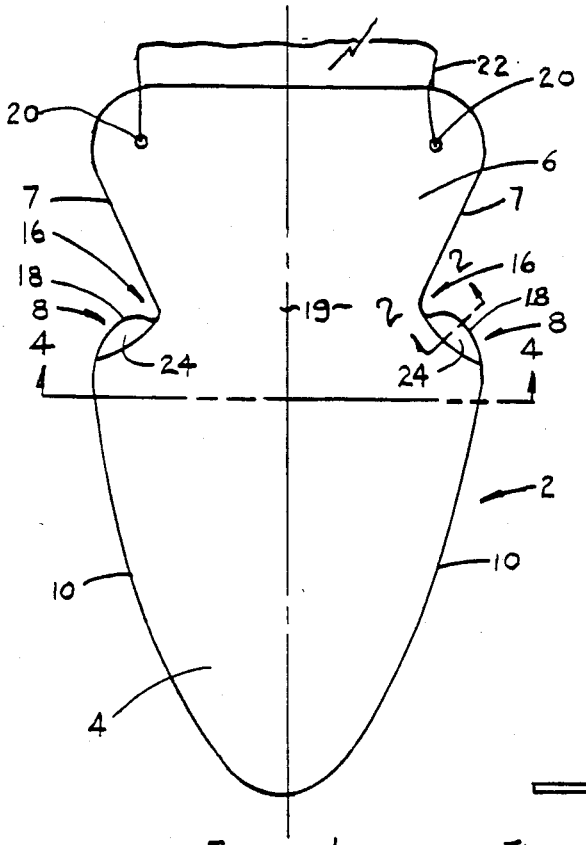
FIG. 1 is a top plan view of the device.

FIG. 1 illustrates the foot device generally as 2. The foot device 2 is comprised of flexible sheet material such as plastic or the like.

The foot device 2 includes a toe portion 4 and a heel portion 6 which are integrally connected in the region adjacent the lateral engaging projections 8.

Figure 4:
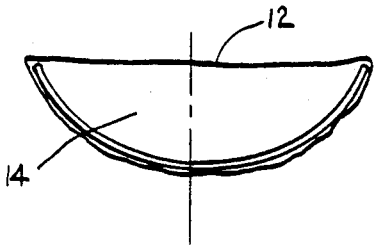
FIG. 4 is a cross-sectional view of the device taken along the line IV—IV of FIG. 1 with the sock distended thereover.

The toe portion 4 has two opposite diverging edge formations 10 which are adapted to flex towards each other upon application of a sock 12 distended thereon, so as to present a cavity 14 between the toe portion 4 and the sock 12 for insertion of a foot as more fully particularized in FIG. 4.

Figure 2:
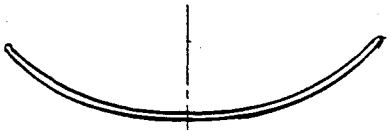
FIG. 2 is a front elevational view of the device.

In the preferred embodiment disclosed the device 2 has a "U-shaped" configuration as best illustrated in FIG. 2. However, it is also possible that the device 2 has an initial flat configuration (not shown) which is adapted to flex so as to present a "U-shaped" configuration upon application of the sock 12.

The edge formations 10 diverge so as to enable the user to easily insert a sock 12 thereover. The toe edge formations 10 terminate at opposite lateral engaging projections 8. The engaging projections 8 are formed by removing a portion of the flexible sheet material along the edge of the device 2 so as to present recesses 16 and a curvate edge 18 as well as a flexible connecting portion or neck 19. The flexible connecting portion 19 integrally connects the toe portion 4 and the heel portion 6. The heel portion 6 also presents diverging edge formations 7 as well as holes 20 which are adapted to receive the ends of a thread or rope 22.

The edge 18 of engaging projections 8 are curvate so as to permit the user to easily gather a sock 12 over the toe portion 4 and slip the sock 12 over the engaging projections 8. As the distance between the engaging projections 8 is greater than the internal dimension of the sock 12, the projections 8 will frictionally engage the inside of the sock 12. This will also cause the edge formations 10 to flex towards one another.

Furthermore, the open end of the sock 12 is gathered within the recesses 16 whereby the sock 12 grips the connecting portion 18 due to the stretchy nature of the fabric of the sock 12.

Figure 6:
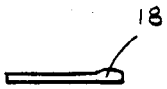
FIG. 6 is a cross-sectional view of the protrusions taken along the line 2—2 of FIG. 1.
Figure 3:
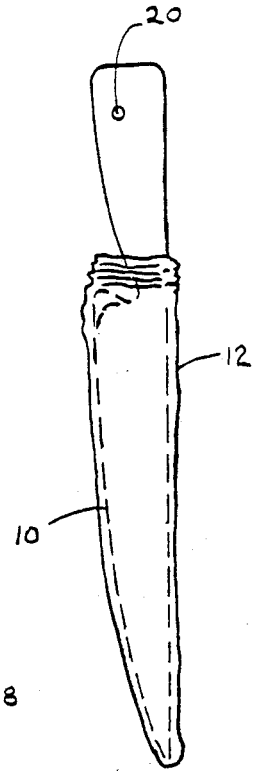
FIG. 3 is a side elevational view of the device with a sock distended thereover.

The lateral engaging projections 8 also present raised protrusions 24 as best seen in FIG. 6. The raised protrusions 24 assist in the uniform unravelling of the sock 12 as the protrusions direct the sock 12 over the projections 8 as the sock 12 is unravelled thereby minimizing the possibility of hooking or snagging the sock 12 about projections 8.

The operation of the device 2 shall now be described. In order for a user to apply a sock 12 or the like onto the foot, the toe portion 4 of the device 2 is inserted into the open end of the sock 12. The sock 12 is then stretched or distended over the device 2 which causes the toe edge formations 10 to flex towards one another. The sock 12 is then stretched over lateral projections 8 which frictionally releasably engage the sock 12. The open end of the sock 12 is gathered within recesses 16.

The user may then place the device 2 onto the floor while retaining hold of the thread 22. The device 2 is placed on the floor so that the convex portion of the device 2 and sock 12 contacts the floor.

Thereafter the user inserts the toes of the foot into the cavity 14, and pulls the thread 22 so as to draw the sock over the foot of the user. As the device 2 is pulled over the foot of the user, the sock 12 is unravelled from recesses 16 and the protrusions 18 direct the sock over the projections 8.

Figure 5:
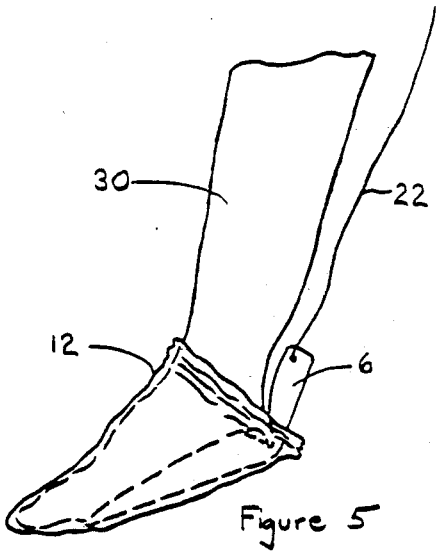
FIG. 5 is a perspective view of the device pulled over the heel of the operator.

As the device 2 and the sock 12 are drawn over the heel of the user, the heel portion 6 of the device 2 hingedly flexes relative the toe portion 4 of the device 2 as illustrated in FIG. 5. This hinged flexture minimizes the possibility of the sock 12 from falling off the device 2 before clearing the heel of the user.

Figure 7:
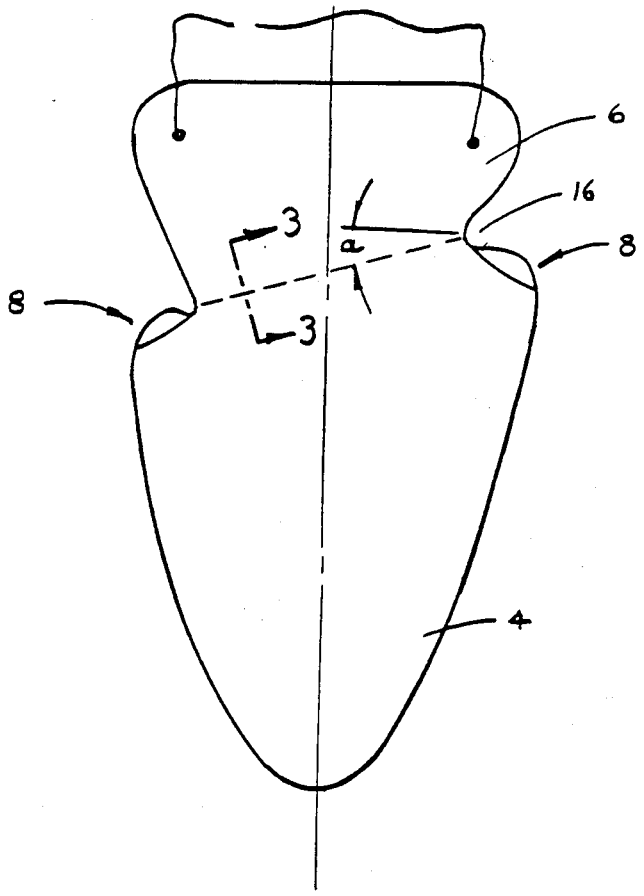
FIG. 7 is a top plan view of another embodiment of the invention.
Figure 9:
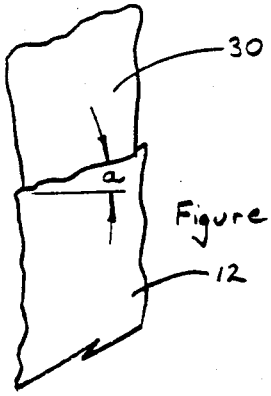
FIG. 9 is a perspective view of the device pulled up the leg of the operator.

FIGS. 7 and 9 illustrate another embodiment of the invention whereby the device 2 presents lateral engaging projections 8 which are displaced or offset along the length of the device 2 so as to facilitate the application of the sock or the like up along the leg 30. Since the lateral engaging projections are offset along the length of the device the ends of the sock 12 which are carried on the engaging projections 8 are also displaced relative one another by an angle "a". Such orientation makes it easier for the user to pull the sock 12 distended over the device 2 up the leg 30.

Figure 8:
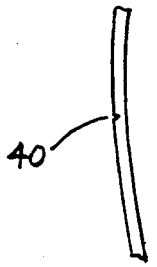
FIG. 8 is a cross-sectional view of the score line taken along the line 3—3 of FIG. 7.

Furthermore the device 2 illustrated in FIG. 8 also presents a score line 40 on the convex side of the device 2 between the two lateral engaging projections 8 which enhances the flexibility of the heel portion 6 about the toe portion 4.

Moreover the device 2 with offset lateral engaging projections 8 illustrated in FIG. 7 tends to turn the sock 12 around the heel of the user as the device 2 with sock 12 is pulled over the heel which improves the ease in which the user may apply the sock or the like to the user's foot.

Although the preferred embodiment as well as the operation and use has been specifically described in relation to the drawings, it should be understood that variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A manually operable device for applying socks or the like comprising:

(a) a flexible sheet material having:

(i) a toe portion at one end thereof with two opposite diverging edge formations adapted to flex towards each other upon application of a sock distended thereon, so as to present a cavity between the toe portion and sock for insertion of a foot;

(ii) said toe edge formations terminating at opposite lateral engaging projections adapted to releasably frictionally engage said sock;

(iii) a heel portion at the other end of such sheet material integrally connected to said toe portion in the region adjacent said engaging projections, said heel portion having two opposite edge formations diverging from said engaging projections to said other end, so as to present a flexible connecting portion between said toe and heel portions to permit hinged flexure of said heel portion relative said toe portion;

(iv) thread means connected to said heel portion and adapted to be pulled so as to draw said toe portion with said sock over the foot thereby unravelling said sock from said engaging projections and permitting said heel portion to flex over the heel of the operator for drawing said sock over the leg.

2. The device as claimed in claim 1 wherein said engaging projections include protrusions which direct the sock thereover.

3. The device as claimed in claim 1 wherein said device presents a curved surface having a generally U-shaped cross section between said ends.

4. A manually operable device for applying socks or the like comprising:

(a) a flexible sheet material having:

(i) a toe portion at one end thereof with two opposite diverging end formations adapted to flex towards each other upon application of a sock distended thereon, so as to present a cavity between the toe portion and sock for insertion of a foot;

(ii) said toe edge formations terminating at opposite lateral engaging projections adapted to releasably frictionally engage said sock;

(iii) a heel portion at the other end of said sheet material, integrally connected to said toe portion in the region adjacent said engaging projections, said heel portion have two opposite edge formations diverging from said engaging projections to said other end so as to present a flexible connecting portion between said toe and heel portions to permit hinged flexure of said heel portion relative said toe portion;

(iv) said opposite lateral engaging projections displaced relative one another along the length of said device between said ends;

(v) thread means connected to said heel portion and adapted to be pulled so as to draw said toe portion with said sock over the foot thereby unravelling said sock from said engaging projections and permitting said heel portion to flex over the heel of the operator for drawing said sock over the leg.

5. A device as claimed in claim 4 wherein said engaging projections include protrusions which direct the sock thereover.

6. The device as claimed in claim 5 wherein said device presents a curved surface having a generally U-shaped cross section between said ends.

7. The device as claimed in claim 6 including a score line between said lateral engaging projection on the convex side of said curved surface.

* * * * *